US005150166A

United States Patent [19]

Matsuura et al.

[11] Patent Number: 5,150,166

[45] Date of Patent: Sep. 22, 1992

[54] IMAGE FORMING SYSTEM INCLUDING ATTACHABLE SHEET SUPPLYING UNITS FOR TRANSPORTING SHEETS DIRECTLY TO AN IMAGE FORMING PART

[75] Inventors: Yasuhiro Matsuura; Hiroaki Kojima; Hirofumi Hasegawa; Naoto Ohmori; Yukio Yamada, all of Osaka, Japan

[73] Assignee: Minolta Camera Co., Ltd., Osaka, Japan

[21] Appl. No.: 423,770

[22] Filed: Oct. 18, 1989

[51] Int. Cl.[5] ..... B41J 11/00

[52] U.S. Cl. ..... 355/308; 346/160.1

[58] Field of Search ..... 355/309, 321, 308; 271/9, 163; 346/153.1, 160.1

[56] References Cited

U.S. PATENT DOCUMENTS

| | | | |
|---|---|---|---|
| 4,222,660 | 9/1980 | Furuichi et al. | 355/309 X |
| 4,436,406 | 3/1984 | Murasaki et al. | 355/309 |
| 4,657,375 | 4/1987 | Watanabe et al. | 355/308 |
| 4,772,921 | 9/1988 | Ito | 271/9 X |
| 4,796,055 | 1/1989 | Takano | 355/206 |
| 4,872,659 | 10/1989 | Kato et al. | 271/9 |
| 4,945,390 | 7/1990 | Hasegawa et al. | 355/321 |
| 4,975,749 | 12/1990 | Tsunoda et al. | 355/321 X |

FOREIGN PATENT DOCUMENTS

| | | | |
|---|---|---|---|
| 53-138843 | 3/1977 | Japan . | |
| 0152739 | 9/1983 | Japan | 271/9 |
| 0012429 | 1/1985 | Japan | 271/9 |
| 61-192637 | 8/1986 | Japan . | |
| 64-75355 | 3/1989 | Japan . | |

*Primary Examiner*—A. T. Grimley
*Assistant Examiner*—Nestor R. Ramirez
*Attorney, Agent, or Firm*—Willian Brinks Olds Hofer Gilson & Lione

[57] ABSTRACT

An image forming system for copiers, printers and the like having a main body which forms images on sheets of paper inserted therein and a plurality of sheet feeding units selectively attachable to the main body. The main body has a timing roller set which transports the papers to an image forming position with an appropriate timing, and each of the sheet feeding units has a paper feeding system with a take-up roller for supplying papers from the unit directly to the timing roller set without intermediate rollers in the main body. The system further includes side and bottom sheet feeding units selectively attachable to the main body and the side unit includes a guide for guiding sheets from the bottom unit into the main body. The system further includes a separate sheet guide mountable on the bottom unit for guiding sheets into the main body when the side unit is absent from the system. The invention permits the paper feeding construction of the image forming systems to be easily and freely changed as a whole.

4 Claims, 3 Drawing Sheets

IMAGE FORMING SYSTEM INCLUDING ATTACHABLE SHEET SUPPLYING UNITS FOR TRANSPORTING SHEETS DIRECTLY TO AN IMAGE FORMING PART

BACKGROUND OF THE INVENTION

1. Field of the Invention

The present invention relates to an image forming apparatus system for copiers, printers, facsimiles and the like.

2. Description of the Related Art

In general, standardized sheet feeding configurations have been established for image forming apparatus used in copiers, printers and the like.

Therefore, due to restrictions in layout or installation positioning of the image forming apparatus, it is common for the user to attach optional sheet feed devices to modify the previously described standard sheet feeding configuration.

Conventional image forming apparatus used in, for example, electrophotographic devices, are provided with a sheet feeding system employing a take-up roller to take up a sheet accommodated within a paper tray or the like so as to supply said sheet to the interior of the image forming apparatus, said take-up roller being disposed before a timing roller which outputs the sheet at a prescribed timing to a transfer position at which a toner image formed on a photoconductive surface is transferred to said sheet. Since the paper supply path is fixed in conventional image forming devices, the degree of freedom with which the sheet feeding configuration of the image forming apparatus may be modified is severely curtailed, and even if optional attachments are installed, the apparatus has the disadvantage of not allowing the paper feed path to be readily modified to achieve the optimum path desired by the user.

SUMMARY OF THE INVENTION

A main object of the present invention is to provide an image forming apparatus system which allows a user to select a desired paper feed path configuration.

Another object of the present invention is to provide an image forming apparatus which allows the paper feeding configuration to be readily modified.

A further object of the present invention is to provide an image forming apparatus which allows a high degree of freedom in the modification of the paper feeding configuration.

These and other objects are accomplished by an image forming apparatus system comprising a main unit having an image forming means, and a plurality of sheet feeding units having different sheet feeding configurations.

BRIEF DESCRIPTION OF THE DRAWINGS

These and other objects or features of the present invention will become apparent from the following description of a preferred embodiment thereof taken in conjunction with the accompanying drawings, in which.

DESCRIPTION OF THE PREFERRED EMBODIMENT

The preferred embodiment of the present invention installed in a printer is described hereinafter with reference to the accompanying drawings.

Figure 1:
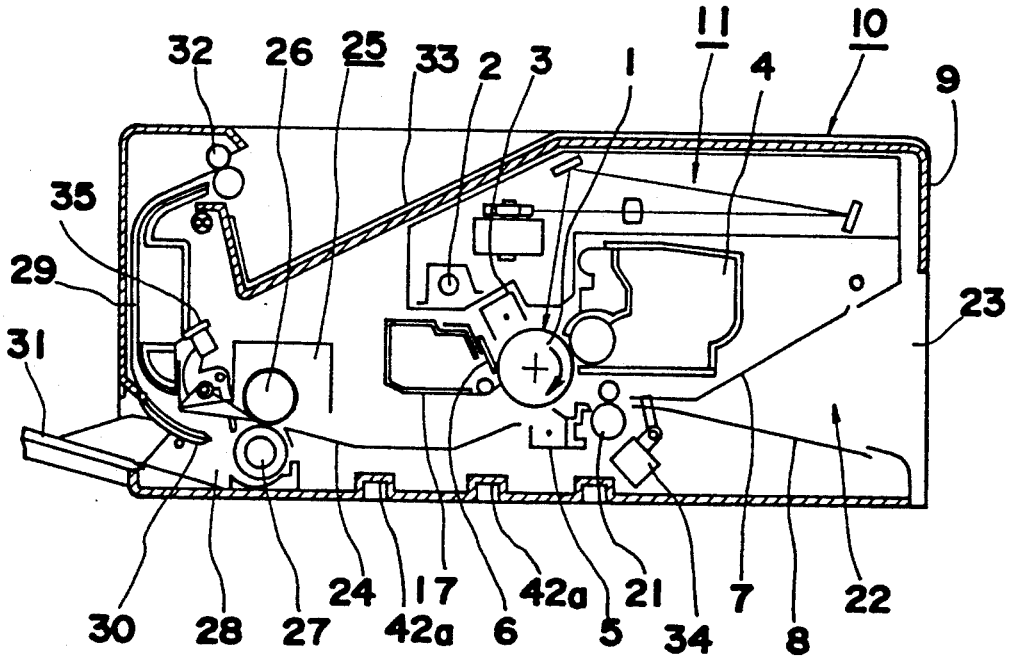
FIG. 1 is a cross section view of a main body of a printer adapted for the present invention.

FIG. 1 is a brief cross section view showing the construction of a main body in a printer system.

The main body 10 is enclosed in a housing 9, and a rotatably driven photoconductive drum 1 is provided in the center portion thereof. Disposed sequentially in the clockwise direction around the aforesaid photoconductive drum 1 are an eraser lamp 2, charger 3, developing device 4, transfer charger 5, blade-type cleaner device 6, and a waste toner box 17 attached to said blade cleaner device 6. Photoconductive drum 1 is provided with a photoconductive layer on the surface thereof, which, with each rotation of said photoconductive drum 1, is exposed to light from eraser lamp 2, then charged by passing by charger 3 and subsequently exposed to a laser beam from laser exposure device 11 that is controlled so as to switch ON and OFF in accordance with the image data, thereby forming an electrostatic latent image on the surface of said photoconductive drum 1.

A timing roller set 21 is provided at the lower right side of photoconductive drum 1, and a paper transport path 22 is formed by guide plates 7 and 8 to guide sheets transported from said timing roller set 21. The cross sectional configuration of paper path 22 is of diverging-shape with the wide end confronting a side of the printer housing, and is connected to paper feed port 23 which opens on the side of the main body.

On the other hand, a sheet discharge path 24 is formed at the lower left side of photoconductive drum 1, and a fixing device 25 comprising a heating roller 26 and pressure roller 27 are disposed at the discharge end of said sheet discharge path 24. A side sheet discharge path 28 and top sheet discharge path 29 are formed so as to be connected to the aforesaid fixing device 25, said side and top sheet discharge paths 28 and 29 being selectable by means of switching a switching hook 30. A discharge tray 31 is provided at the discharge end of side discharge path 28. A discharge roller set 32 is provided at the discharge end of top discharge path 29 to discharge the sheet to a tray 33 having a concave configuration and provided at the top of the housing 9.

Item 34 is a sheet sensor which detects a sheet transported by timing roller set 21, and item 35 is a sheet discharge sensor which detects a sheet discharged from fixing device 25.

Image data produced by a host unit is exposed onto the photoconductive drum 1 by the ON/OFF switching of the previously mentioned laser beam, and said image exposure forms an electrostatic latent image on the surface of said photoconductive drum 1. Toner accommodated in developing device 4 is adhered to the electrostatic latent image by the actuation of said developing device 4, then the toner image formed on the surface of photoconductive drum 1 is transferred by means of transfer charger 5 to a sheet transported by timing roller set 21 with a timing that positions the leading edge of said sheet to correspond to the front edge of the toner image region. The sheet bearing the transferred toner image is separated from the surface of photoconductive drum 1 and transported through discharge path 24 to fixing device 25. The toner is fused to the aforesaid sheet in fixing device 25, and thereafter the sheet is transported to either discharge tray 31 or discharge tray 33 through either side discharge path 28 or top discharge path 29 in accordance with the positioning of switching hook 30.

Photoconductive drum 1, timing roller set 21, developing device 4, fixing device 25 and discharge roller set 32 are constructed so as to be operated by means of a main motor not shown in the drawings. The aforesaid timing roller set 21 and developing device 4 may be constructed in such a way that the driving force of the main motor is selectively transmitted or not transmitted thereto by the interaction of a solenoid, magnetic spring clutch or the like (not shown in the drawing), so as to allow said timing roller set 21 and developing device 4 to be independently operated.

Figure 2:
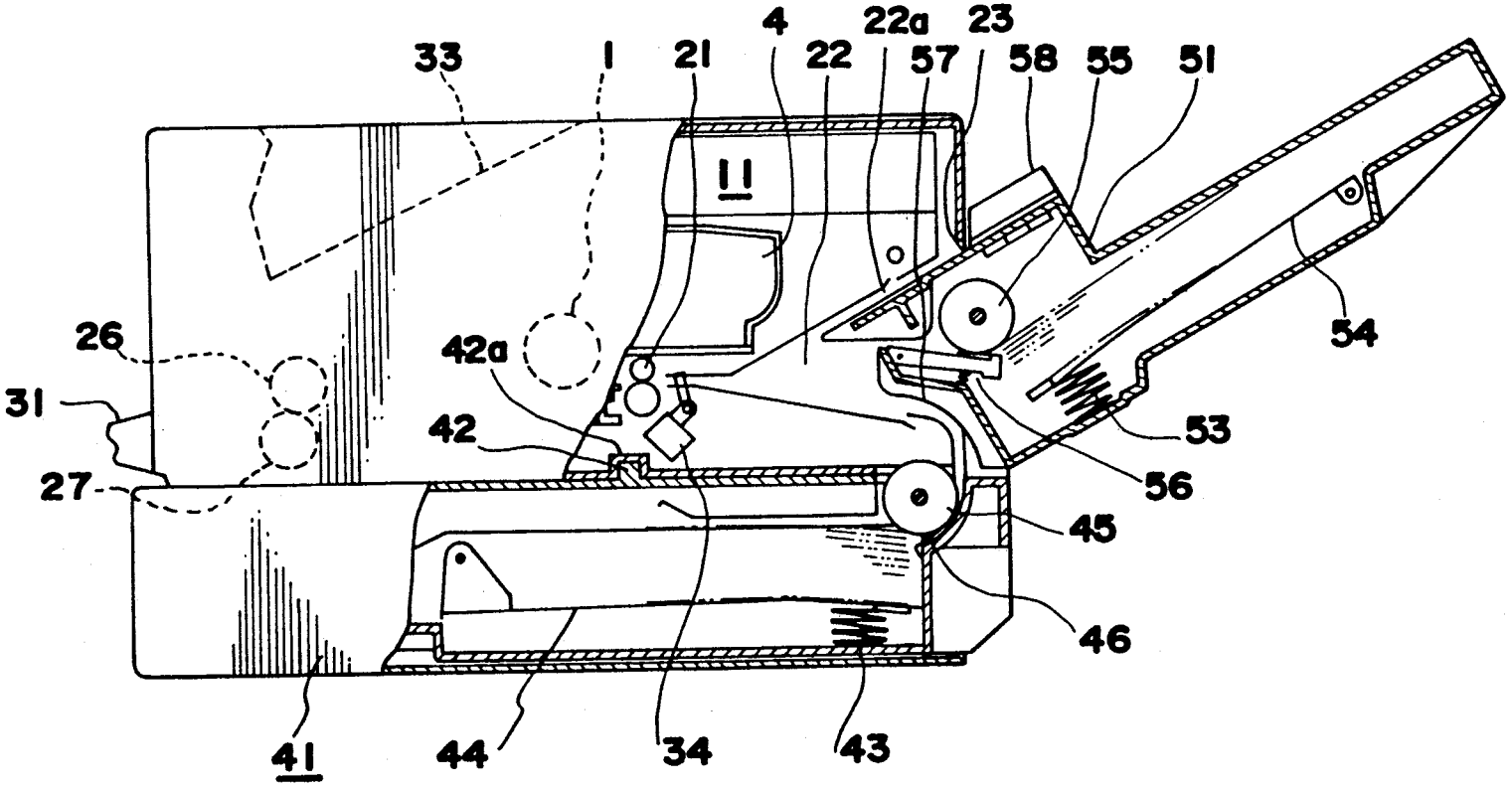
FIG. 2 is a cutaway elevation view of a portion of the main body accommodating sheet feeding units 41 and 51.

FIG. 2 is a partial cutaway elevation view showing sheet feeding units 41 and 51 respectively installed at the bottom and side of the main body 10.

Bottom sheet feeding unit 41 is disposed with the main body on top, so that both are properly aligned by inserting a projection 42 provided on top of unit 41 into a channel 42*a* provided on the bottom of the printer housing.

Side sheet feeding unit 51 is installed in paper feed port 23, which forms an opening in the side of the printer housing, so as to have one side confront said paper feed port 23 and the other side positioned so as to be in an inclined state.

Sheet feeding units 41 and 51 are both provided with sheet loading plates 44 and 54 which are supported so as to be rotatable at one end and have the other ends being respectively acted upon by riser springs 43 and 53. Take-up rollers 45 and 55 make contact with the topmost sheets stacked on the sheet loading plates 44 and 54, said take-up rollers 45 and 55 being disposed so as to confront pads 46 and 56 and have the sheets transported therebetween one sheet at a time.

The bottom portion of side sheet feeding unit 51, which is inserted into port 23, forms a curved sheet guide 57 so that a sheet taken up by take-up roller 45 may be transported via a U-turn configuration to transport path 22 which has a diverging-shaped cross section when the bottom sheet feeding unit 41 is selected. Further, the top of sheet feeding unit 51 and the sheet guide surface 7 on top of transport path 22 form a manual feed transport path 22*a*, and manual feed sheet guides 58 are provided on top of sheet feeding unit 51 so as to be movable perpendicularly relative to the direction of sheet transport so as to be adjustable to correspond to sheets of various sizes.

When installed in the main body, both of the sheet feeding units 41 and 51 are connected to the previously described printer main motor by means of a belt drive system or gear linkage system or the like not shown in the drawings, so that either take-up roller 45 or take-up roller 55 is actuated according to a specified image process to transport the specified sheet to timing roller set 21.

Figure 3:
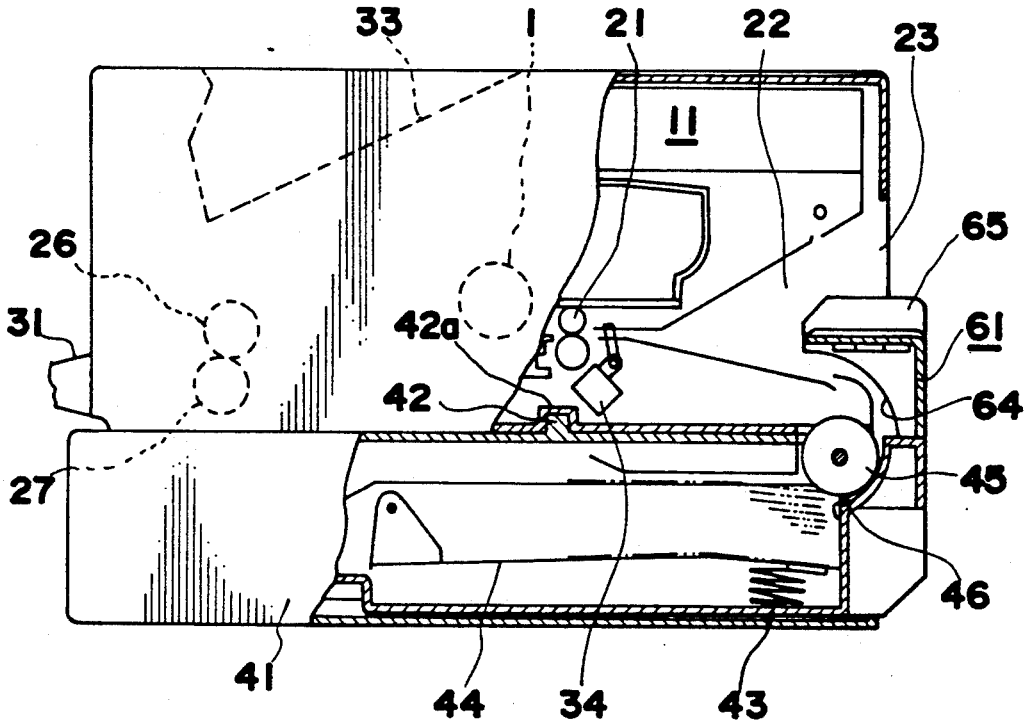
FIG. 3 is a cutaway elevation view of a portion of the main body accommodating sheet feeding unit 41 and sheet guide 61.

FIG. 3 is a section view showing the side sheet feeding unit 51 removed from the main body.

The aforesaid sheet feeding configuration feeds paper from the bottom sheet feeding unit 41 to the timing roller set 21. Since the side sheet feeding unit 51 is absent, a separate sheet guide 61 for transporting the sheets to transport path 22 through a U-turn shaped configuration is mounted on bottom sheet feeding unit 41.

Figure 4:
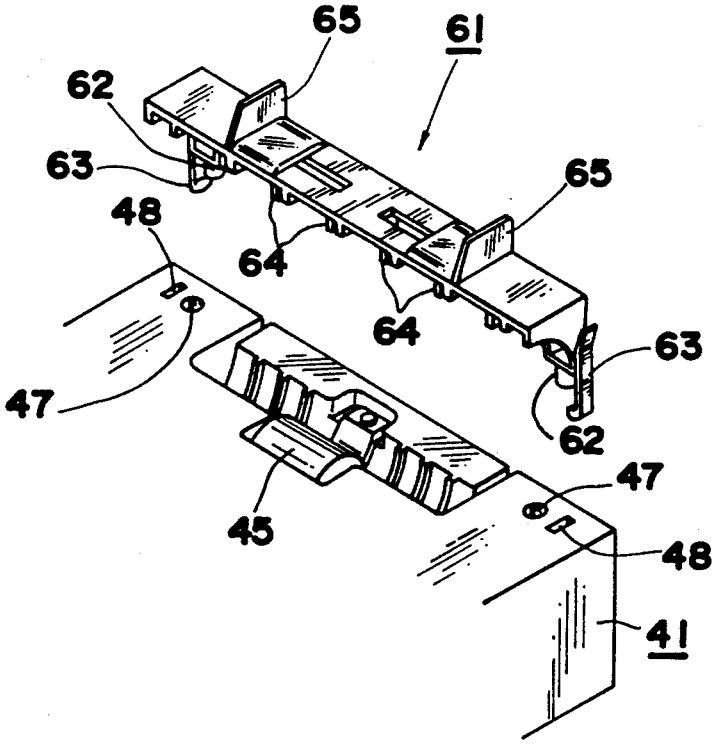
FIG. 4 is a partial perspective view of the sheet feeding unit 41 and sheet guide 61.

As shown in FIG. 4, the separate sheet guide 61 is provided with curved guides 64 for guiding the sheet through a U-turn shaped path and which are formed with uniform spacing in the width direction. At both ends of said separate sheet guide 61 are provided with positioning pins 62 and latches 63 are inserted into positioning ports 47 and latch catches 48 disposed on the top of sheet feeding unit 47 so as to be locked therein. Latches 63 are released by an external operation so that sheet guide 61 may be removed. At the top of sheet guide 61 is also provided a universal-type manual sheet insertion guide 65 has the same construction as the previously described sheet insertion guide 58 shown in FIG. 2.

The foregoing explanation describes the sheet feeding configuration when the bottom sheet feeding unit 41 is selected, however, a further configuration is possible wherein the bottom sheet feeding unit 41 is removed and the side sheet feeding unit 51 alone is selected and installed.

As clearly indicated in the descriptions of specific means and operation, the printer system described in the aforesaid embodiment would not make a sheet feeding configuration fixed as in a conventional apparatus because the main body of the printer system does not have any sheet feeding means to transport the sheet to a timing roller set, but is provided a sheet transport path for directly transporting the sheet and can be combined with one or more sheet feeding units selected by a user in which a sheet feeding system having a take-up roller and the like is disposed. Further, the freedom with which the sheet feeding units may be installed is unrestricted, and the sheet feeding configuration may be modified by attaching a separate sheet guide so that a user may readily accomplish a desired optimum sheet feeding configuration and a manual sheet feeding configuration may be achieved in each sheet configuration mode.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming system comprising:

a main body having an image forming part which includes image forming means for forming an image on a sheet of paper and timing roller means for transporting the sheet of paper in synchronization with an image forming operation of said image forming means;

a plurality of sheet supplying units, each of the sheet supplying units being adapted to contain a stack of sheets, being selectively attachable to said main body, and being different from each other in construction for supplying sheets to the image forming part, each of said plurality of sheet supplying units further including a sheet supplying means for transporting sheets one by one directly to said image forming part when said sheet supplying unit is attached to said main body without any intermediate sheet transporting means in said main body between said sheet supplying means in said sheet supplying unit and said image forming part, wherein said plurality of sheet supplying units includes a first unit which is attachable on a side of said main body and is provided thereon with one of said sheet supplying means for transporting sheets to said main body along a substantially horizontal direction, and a second unit which is attachable to an undersurface of said main body and is provided thereon with another one of said sheet supplying means for transporting sheets to said main body in a substantially upward direction, wherein said main body includes means for attaching both said first and second units thereto at the same time, and wherein said first unit has a guide member for guiding sheets from said second unit toward said image forming part; and wherein said system further comprises a sheet guiding unit attachable to said main body together with said second unit for guiding sheets from said second unit toward said image forming part when said first unit is not attached to the main body.

2. An image forming system comprising:

a main body having an image forming means;

a first sheet supplying unit which is attachable on a side of said main body and has a take-up roller for supplying sheets one by one from a stack of sheets adapted to be contained in the first sheet supplying unit into said main body along a substantially horizontal direction;

a second sheet supplying unit which is attachable to an undersurface of said main body and has a take-up roller for supplying sheets one by one from a stack of sheets adapted to be contained in the second sheet supplying unit into said main body in a substantially upward direction, wherein said main body includes means for attaching both said first and second sheet supplying units thereto at the same time, and wherein said first sheet supplying unit has a guide member for guiding the sheets from said second sheet supplying unit toward said image forming means; and wherein said system further comprises a sheet guiding unit attachable to said main body together with said second sheet supplying unit for guiding sheets from said second sheet supplying unit toward said image forming means when said first sheet supplying unit is not attached to said main body.

3. An image forming system as claimed in claim 2, wherein said sheet guiding unit has a pair of manual paper insertion guides for guiding sides of a sheet of a paper manually inserted to said opening, at least one of said manual paper insertion guides being movable perpendicularly to a direction to insert the sheet of paper in accordance with a size of the sheet of paper.

4. An image forming system comprising:

a main body having an image forming means and a housing member which encloses the image forming means;

first and second units which are attachable to said main body at the same time and each of which is adapted to contain a stack of sheets to be supplied one by one into said main body;

wherein said second unit has a take-up roller for supplying sheets one by one from the stack of sheets in the second unit into said main body, and said first unit has a guide member for guiding sheets from said second unit toward said image forming means, and wherein said housing member has an opening for receiving sheets of paper from said first and second units, and said guide member guides the sheets from said second unit so that the sheets from said second unit are fed into said housing member through the same opening that sheets from said first unit are fed; and wherein said system further comprises a sheet guiding unit attachable to said main body together with said second unit for guiding sheets from said second unit toward said image forming means when said first unit is not attached to said main body.

* * * * *